United States Patent [19]

Boehmke

[11] 4,297,107

[45] Oct. 27, 1981

[54] FUELS AND THEIR USE

[75] Inventor: Günther Boehmke, Leverkusen, Fed. Rep. of Germany

[73] Assignee: Bayer Aktiengesellschaft, Leverkusen, Fed. Rep. of Germany

[21] Appl. No.: 99,122

[22] Filed: Nov. 30, 1979

[30] Foreign Application Priority Data

Dec. 16, 1978 [DE] Fed. Rep. of Germany ..... 2854540

[51] Int. Cl.[3] ..... C10L 1/18; C10L 1/22

[52] U.S. Cl. ..... 44/51; 44/71; 44/56; 44/77; 252/308; 252/DIG. 1

[58] Field of Search ..... 44/51, 71, 56, 77, 66; 252/DIG. 1, 308, 309

[56] References Cited

U.S. PATENT DOCUMENTS

| | | | |
|---|---|---|---|
| 2,520,381 | 8/1950 | Carnes | 252/DIG. 1 |
| 2,736,641 | 2/1956 | Mattson | 44/71 |
| 3,876,391 | 4/1975 | McCoy et al. | 44/51 |
| 4,084,940 | 4/1978 | Lissant | 44/51 |
| 4,173,455 | 11/1979 | Fodor et al. | 44/51 |

*Primary Examiner*—Jacqueline V. Howard

*Attorney, Agent, or Firm*—Sprung, Felfe, Horn, Lynch & Kramer

[57] ABSTRACT

A fuel especially a fuel for an automobile, internal combustion engine or a diesel engine comprising a hydrocarbon water and emulsifier wherein the emulsifier is a non-ionic emulsifier and comprises the addition product of ethylene oxide or propylene oxide and a carboxylic acid amide with 9 to 21 carbon atoms.

12 Claims, No Drawings

FUELS AND THEIR USE

The invention relates to fuels for combustion engines such as gasoline engines and diesel engines as well as rotary piston engines and turbines, which contain emulsifiers or emulsifier mixtures and water and, if appropriate, alcohols, in the fuels customary for the particular units.

The use of water and emulsifiers in fuels for promoting combustion has already been disclosed (German Offenlegungsschrift No. 1,545,509 and German Offenlegungsschrift No. 2,633,462). Thus, for example, the knocking properties of gasoline in relatively high compression engines is more advantageously influenced by water than by the addition of methanol, which is frequently proposed (Motorzeitschrift, year 37, No. 5, page 187 (1976); SAE Publication No. 750,123). However, a number of in some cases considerable disadvantages, in particular inadequate stability in the cold, had to be tolerated in the case of the emulsifiers hitherto employed.

Combustion engine fuels which contain a non-ionic emulsifier, water and, if appropriate, an alcohol have now been found, which are characterized in that they contain, as the emulsifier, an addition product of ethylene oxide or propylene oxide and a carboxylic acid amide with 8-22 carbon atoms.

The fuels according to the invention preferably contain 40–95% by weight of hydrocarbons, 0.5–6% by weight of a non-ionic emulsifier of the formula

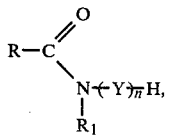

(I)

in which

R represents an optionally substituted, straight-chain, branched or cyclic, saturated or unsaturated hydrocarbon radical, Y denotes the grouping

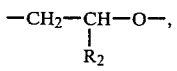

wherein $R_2$ denotes hydrogen or methyl, and in which n represents an integer from 1 to 50, preferably 1 to 25, and $R_1$ represents hydrogen or denotes the grouping $-(Y)_nH$, 0–20% by weight of a straight-chain or branched, saturated or unsaturated alcohol containing 1–8 carbon atoms, and 0.5–35% by weight of water.

A fuel composition containing 60–95% by weight of a hydrocarbon or of a hydrocarbon mixture, 1.0–3.5% by weight of one or more emulsifiers of the formula (I), if appropriate 0.5–10% by weight of a $C_1$–$C_8$-alcohol and water as the remainder, is particularly preferred.

The hydrocarbons contained in the fuels according to the invention are in general the mixtures customary for this purpose, such as those characterized by their physical data in DIN Specification 51,600 or in United Stated Federal Specification VV-M-561 a-2 of 30th Oct. 1954. These are aliphatic hydrocarbons from gaseous, dissolved butane up to $C_{20}$-hydrocarbons (as the residual fraction of diesel oil), for example cycloaliphatics, olefinic and/or aromatic hydrocarbons, naturally occurring naphthene-based hydrocarbons or refined technical grade hydrocarbons. The compositions according to the invention preferably contain no lead alkyls and similar toxic additives.

The non-ionic emulsifier is preferably a fatty acid amide which can be thought of as being formed by adding 1 to 50 mols of ethylene oxide or propylene oxide onto a fatty acid amide and which has the formula

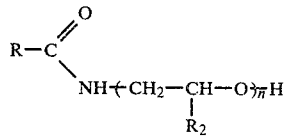

(II)

in which

R, $R_2$ and n have the abovementioned meaning.

The radical R generally denotes the radical of a saturated or unsaturated carboxylic acid which can be varied within very wide limits with regard to its molecular structure. Examples which may be mentioned are fatty acids, such as, for example, octanoic acid, decanoic acid, lauric acid, myristic acid, palmitic acid, stearic acid, behenic acid, arachic acid or oleic acid, erucic acid, ricinoleic acid or mixtures thereof, such as are found, for example, in coconut oil, palm oil, sunflower oil, safflower oil, soya bean oil, caster oil, sperm oil, fish oil, tallow fat or lard. Generally R has up to 25 C-atoms, especially 7 to 21 C-atoms.

The proposed emulsifiers of the formula (I) are already known (compare M. J. Schick, Nonionic Surfactants, volume 1, pages 209–211; M. Dekker, New York 1976). They are very acceptable physiologically (use in detergents for washing by hand) and are biologically degradable. The fatty raw materials are available in large amounts, which can even be increased in the long term since the materials do not depend on fossil deposits. Synthetic acids such as are formed in the oxidation of paraffin or in the oxidation of α-olefines or tripropylene and tetrapropylene can, of course, also be employed. If the amides are prepared from the naturally occurring triglycerides, these triglycerides can still contain the monoglycerides of these fats if only two of the fatty acid radicals of the triglyceride are utilised for the amide formation.

The degree of oxyethylation, that is to say the nature and number of the groupings Y of the formula (I), can be varied within wide limits. Compounds of the formula (I) which are adducts of 1-3 mols of ethylene oxide and 1 mol of carboxylic acid amide and/or of 5–25 mols of ethylene oxide and/or propylene oxide and 1 mol of carboxylic acid amide are advantaged sly employed as the emulsifiers. The content in the fuel according to the invention can be, for example, 15–70% by weight in the case of the 1–3:1 adduct and 30–85% by weight in the case of the 5–25:1 adduct. The emulsifier comprising the adduct of 1–2 mols of ethylene oxide and 1 mol of fatty acid amide (if appropriate mixed with portions of a fatty acid monoglyceride arising from the preparation) and/or the adduct of 5–10 mols of ethylene oxide and/or propylene oxide and 1 mol of fatty acid amide, and if appropriate the adduct of 20–30 mols of ethylene oxide and 1 mol of fatty acid amide is particularly preferred.

The emulsifiers are most advantageously prepared via the fatty acids and ethanolamine (compare M. Shick, Nonionic Surfactants, loc. cit. pages 213–214). A fatty acid amide according to the invention containing 1 mol of ethylene oxide can be prepared with a very high degree of purity from these components by splitting off water at 160°–180° C. in the course of about 60–90 minutes. If the fatty acid amide is used as the starting material (compare M. Schick, Nonionic Surfactants, loc. cit. page 213), 1 mol of ethylene oxide is added on, advantageously at elevated temperature, for example at 100°–140° C., and if necessary under catalysis with a weak acid or weak base. To achieve a greater uniformity of the products it can be appropriate to start with the 1:1 adduct with the customary oxyalkylation catalysts, such as sodium hydroxide, sodium methylate and potassium hydroxide, and to add on the desired amount of ethylene oxide under pressure.

If a naturally occurring fat is used as the starting material, this is reacted with 2 mols of ethanolamine. After about 2–5 hours at a reaction temperature of about 140°–180° C., in general ethanolamine and triglyceride can no longer be detected. This 1:2 molar mixture of fatty acid monoglyceride and fatty acid amide 1:1 ethylene oxide adduct can advantageously be employed in an amount of 15–70% by weight of the non-ionic emulsifier.

The non-ionic emulsifiers can contain impurities from the industrial preparation, which originate from impurities in the precursor, for example from the ethylene oxide, are caused by moisture or stem from the oxyethylation catalyst. These are preferably polyethylene glycols, which can be responsible for deterioration in the quality of the emulsion and for the formation of an aqueous sediment. If they are present in the emulsifiers in amounts of over 1% it is advisable to remove them by one of the known purification operations for non-ionic emulsifiers, for example according to German Pat. No. 828,839. A novel purification method, such as is described by the process of a co-pending application having the title "Non-ionic emulsifiers and a process for their purification" (German patent application No. P. 28 54 541.7; inventor: Guenther Boehmke), is preferably suitable for this purification on an industrial scale. The disclosure of such application is hereby specifically incorporated herein by reference.

Lower alcohols are used in the fuels according to the invention to control the spontaneity of emulsion, the stability in the cold and the dependence of the emulsification of the water on the temperature. In general, spontaneity can be achieved with the aid of mixed emulsifiers of various ionic character. Since for corrosion reasons only non-ionic and residue-free combustible emulsifiers can be used in a motor fuel without difficulty, it must be described as exceptionally surprising that spontaneous water-in-oil emulsions are obtained with the emulsifiers according to the invention. As a result, the fuels according to the invention have a considerably improved stability in the cold, which not only consists in the prevention of the formation of ice crystals, but also is to be attributed to the fact that gel structures which can cause an uncontrolled increase in viscosity do not arise.

Alcohols which may be mentioned are straight-chain or branched aliphatic alcohols and cycloaliphatic alcohols, such as methanol, ethanol, propanol, isopropanol, butanol, iso-butanol, tert.-butanol, amyl alcohol, isoamyl alcohol, hexyl alcohol, 1,3-dimethyl-butanol, cyclohexanol, methylcyclohexanol, octanol and 2-ethylhexanol. Mixtures of these alcohols can also readily be used. Alcohols which are readily accessible industrially are preferably employed, for example methanol, ethanol, isopropanol, isobutanol and 2-ethyl-hexanol.

The fuel emulsion according to the invention is prepared by stirring the water into a solution of the emulsifier in the hydrocarbon, which contains alcohol if appropriate, during which, preferably, no machines which supply further dispersion energy are employed. In a modification of this procedure, the emulsifier, and if appropriate also the alcohol, can be dispersed in gasoline and/or water.

When the emulsion has formed, it is appropriate not to allow the viscosity of the emulsion to rise to values which are considerably higher than 10 m PAs (compare DIN No. 9040), since a viscosity of over 10 m PAs can already mean that the fuel can no longer pass through the normal filters, pumps and jets in the vehicle without trouble. It is thus preferably advisable to keep the viscosity of the fuels according to the invention within 5 m PAs, and for gasoline emulsions, for example, under 2 m PAs. In addition, on cooling to about −15° C., the viscosity of the fuels should not rise considerably and the emulsion should remain stable.

The monoamides, in particular those of the formula (II), to be employed as emulsifiers for the fuels according to the invention have a pronounced rust-protection action. In contrast, the methyl polyether-amides hitherto employed, for example, are largely ineffective. The other emulsifiers hitherto described for use in fuels increase, rather, rust formation in the presence of water, possibly because of their degreasing action.

Moreover, the emulsifier type according to the invention does not lead to increased swelling or detachment in the case of either the plastic part coming into contact with the fuel system or the lacquer surfaces, as can be observed with esters of polyethers.

Another advantage of the fuels according to the invention is that the use of lead tetraalkyls, with the extremely low value for the maximum workplace concentration (MWC value) of 0.01 ppm required for these compounds, can be avoided. Furthermore, the "fluids" (or so-called scavengers, compare Chemiker-Zeitung 97 (1973), No. 9, page 463) which are necessary to remove the lead oxide in the motor and were classified in the IIIB class in the last Accident Prevention Guidelines (Accident Prevention Guidelines of the Chemical Industry Employers Association, Appendix 4, MWC Values List of 1.10.1978) can be dispensed with.

Lowering the temperature of the combustion operation also reduces the amounts of harmful substances in the exhaust (for example the NO content) and because of this "incorporated cooling", the vehicle can be driven economically with the "depleted" mixture. It is no longer necessary to reduce the combustion chamber temperature by an "enriched" mixture, which corresponds to an unnecessarily increased fuel consumption. Since the additives are emulsifiers, their detergent action prevents the unit from becoming dirty.

The ratio of fuel utilized and fuel necessary only for mechanical reasons is, of course, particularly unfavourable in the case of high-speed drive units, such as, for example, in the case of Wankel engines and turbines, which display their driving power only at high speeds of rotation. Furthermore, the heat of combustion necessary rapidly leads to heat build-up problems and thus also to unfavourable exhaust values. In this case it is particularly suitable to use the fuel/water emulsion according to the invention to achieve a more favourable specific consumption and to solve the heat and exhaust problems.

Another advantage of the fuels, according to the invention, containing emulsifiers and water and, if appropriate, alcohols is that their electrostatic charge is greatly reduced, so that a considerable danger when handling fuels is reduced (compare Haase, Statische Elektrizität als Gefahr (Static Electricity as a Danger), Verlag Chemie, Weinheim/Bergstrasse 1968, especially pages 69, 96–99, 114 and 115). The electrostatic charge of the fuels according to the invention is so low that dangerous discharges can no longer occur. At 20° C., the regular grade gasoline used has specific volume resistivity values of about $1.10^{11}$ Ω.cm, and in contrast the fuel according to the invention in general has a specific volume resistivity of less $1.10^{10}$ Ω.cm, for example of $1.10^{7}$ to $1.10^{10}$ Ω.cm. The specific volume resistivity of the fuels according to the invention is preferably $1.10^{8}$ to $9.10^{9}$ Ω.cm. At values of less than $10^{10}$ Ω.cm, there is no longer a danger of electrostatic charging during filling up, transferring and emptying.

Surprisingly, in spite of the water content, which is in some cases considerable, the combustibility of the fuel is retained, and the formation of soot is even reduced. For diesel fuels having a composition according to the invention, the tolerance limit in the fuel/air ratio before the diesel vehicle in its highly polluting, sooty dense smoke is shifted to a far higher value.

The ease with which the fuel emulsions according to the invention ignite is in no way impaired, so that vehicles fire up without delay on starting, even after remaining idle in the open-air for several weeks. This reliablity in operation is also achieved by the outstanding storage stability of the emulsions to be employed according to the invention which do not deposit water, even in small amounts, in the carburettor, the fuel pump or the tank. As a result, the known difficulties on starting and the ignition cut-out on driving are eliminated. Emulsifier systems known hitherto tend to form these so-called water sumps, in particular because of the by-products which they contain.

Finally, an improvement in the octane number is also achieved by using the fuels according to the invention.

The percentage data given in the following examples are per cent by weight, unless otherwise indicated.

EXAMPLE 1

2.4% of a non-ionic oleic acid amide, purified from polyethylene glycol, with 7 mols of ethylene oxide (adduct of 7 mols of ethylene oxide and 1 mol of oleic acid amide), 0.6% of a coconut oil acid amide with 1 mol of ethylene oxide (free from ester constituents) and 1.5% of isobutanol are dissolved in a normal-grade petrol of commercial quality (specific volume resistivity $1.10^{12}$ Ω.cm).

25% of water are allowed to run into the petrol-/emulsifier solution (70.5% of normal-grade petrol), whilst stirring with a stirrer (about 200–300 rmp). When the emulsion has been turned over and over, an opalescent, milky fuel is ready to use. When magnified 900 times under a microscope, only uniform, very fine droplets and no islands of water pressed flat by the slide are visible. The fuel thus prepared has a specific volume resistivity of $3.10^{9}$ Ω.cm.

The viscosity at 20° C. was 0,96 m PAs and the times taken to pass through a Bosch gasoline filter do not differ from that for an equivalent amount of gasoline. An Opel Kadett of 45 horse-power and with a cylinder capacity of 1.1 liters was tested on a HPA test machine (roller test stand) at a speed of 100 km/hour and with a resistance on the rollers of 20 kg for 15 minutes.

The fuel was fed to the carburettor separately from a measuring vessel. The idling jet and full load jet were increased in size somewhat due to the higher surface viscosity and higher density. The external temperature 14° C. The following consumption was determined, from the amount of fuel measured and the number of kilometers covered at about 100 km/hour:

| Fuel emulsion | Regular-grade gasoline (without the above additives) |
|---|---|
| 8.84 l for 100 km | 10.47 l for 100 km |

When the tank was filled with the fuel emulsion, the car could be driven and, after being left to stand for any desired period, could be started again directly. The CO exhaust values were 2.5% by volume.

EXAMPLE 2

3% of the emulsifier used in Example 1, that is to say oleic acid amide with 7 mols of ethylene oxide, is dissolved in 72% of normal-grade petrol and the fuel was processed to an emulsion of the same quality as in Example 1 by slowly stirring 25% of water in. This emulsion can be used for carburettor-type engines at temperature above 15° C.

EXAMPLE 3

If 0.3% of a 1:1 adduct of ricinoleic acid amide and ethylene oxide is also added to the fuel emulsion from Example 2, the fuel can still be used at 0° C.

EXAMPLE 4

To prepare a fuel, 22% of water is emulsified into a mixture of 70% of lead-free regular-grade gasoline, 2,4% of oleic acid amide with 7 mols of ethylene oxide, 0.6% of technical coconut oil acid amide with 1 mol of ethylene oxide (prepared by heating 1 mol of coconut oil to 160° C. with 2 mols of ethanolamine until no further free amine could be titrated) and 5% of a mixture of ethanol and isobutanol (4:1) at external temperatures of about 15° C., whilst stirring thoroughly.

A stable, opalescent, milky emulsion was obtained which had a viscosity of less than 1 m PAs and formed no gel-like streaks even at −10° C.

The tank of a Fiat 128 car, which has a horsepower of 55 and a cylinder capacity of 1,180 ccs and had hitherto been driven on super-grade gasoline, was filled with this fuel. On slightly increasing the suction pressure in the carburettor by partial operation of the choke, the vehicle could be driven in busy urban traffic without a discernible loss in the driving characteristics. Knocking on acceleration (pinking) as is ascertained with gasoline of insufficient quality could be observed neither when the engine was cold nor when it was at the operating temperature. The small amount of dirt on the plugs after driving short distances was remarkable.

EXAMPLE 5

A 1.7 liter Opel Rekord was driven with the fuel prepared as follows:

A mixture of 67% of a lead-free regular-grade fuel, 2.25% of oleic acid amide with 7 mols of ethylene oxide (purified), 0.75% of a technical grade coconut oil acid amide with 1 mol of ethylene oxide (prepared by amidating 1 mol of coconut oil with 2 mols of ethanolamine at 160°-170° C.) and 5% of an alcohol mixture of methanol, isobutanol and 2-ethyl-hexanol (17:2:1) was emulsified with 25% of water at 11°-14° C. (buried tank temperature), whilst stirring.

The fuel formed an opalescent, milky, water-in-oil emulsion, had a viscosity of 1,1 m PAs and displayed no gel-like streaks even at −15° C.

The idling jet and main jet in the carburettor of the vehicle were replaced by jets having diameters about 10% and 15% wider. A consumption of 10.7-11.7 l was established on normal mixed driving of the vehicle in urban traffic and on the motorway. This consumption was also measured earlier with gasoline. The driving behaviour and the maximum speed corresponded to that measured previously with petrol containing lead. Observation of the condition of the plugs indicated clean, residue-free combustion in this mixed traffic. Exhaust measurements showed a CO value of 0.5-1.0%, whilst the same vehicle when driven with a super-grade gasoline had CO values of 3.5-4.5%. When driven continuously, the heating up of the engine observed was less severe than that measured when the vehicle was driven with the prescribed gasoline.

EXAMPLE 6

For better handling of the highly viscous emulsifier mixture from Example 5, the 3% of emulsifier are formulated to a clear, low-viscosity solution with 3% of gasoline and 3% of water. This solution can then readily be dissolved in 64% of gasoline, if necessary using mechanical metering devices, giving a clear solution and the solution can then be emulsified directly with 22% of water. The fuel according to Example 5 is obtained with the same composition and in the same quality.

EXAMPLE 7

The following fuel was prepared, to operate a diesel operation:

70.5% of commercially available diesel oil, 2.3% of stearic acid amide and 5 mols of ethylene oxide (purified goods), 0.7% of coconut oil acid amide and 1 mol of ethylene oxide an 1.5% of isobutanol are dissolved with one another and 25% of water is then emulsified in. It is sufficient to use a simple stirrer.

This emulsion can be used directly or, if low external temperatures are expected, can also be mixed with 5% of methanol. A car with a 2 liter diesel engine could be driven without impairment.

The same quality fuel could be obtained using ricinoleic acid amide with 1 mol of ethylene oxide, which can be prepared in technical grade quality from 1 mol of castor oil and 2 mols of ethanolamine at 160°-180° C. in the course of about 5 hours, when this emulsifier was employed instead of the coconut oil acid amide with 1 mol of ethylene oxide.

EXAMPLE 8

The procedure followed is as in Example 7, but a diesel oil of the following composition is employed: 67.5% of diesel oil, 1.8% of stearic acid amide with 5 mols of ethylene oxide, 0.5% of stearic acid amide with 20 mols of ethylene oxide, 0.7% of coconut oil acid amide with 1 mol of ethylene oxide, 0.5% of 2-ethylhexanol and 29% of water.

This fuel can be used in a diesel-driven vehicle without the difficulties such as can arise from an unstable fuel which separates out into layers.

EXAMPLE 9

67% of regular-grade gasoline were mixed with 1,8% of coconut oil acid amide with 2 mols of ethylene oxide (prepared from coconut oil acids and diethanolamine in a ratio of 1:1). 1.2% of oleic acid amide with 7 mols of ethylene oxide (purified) and 5% of an alcohol mixture (84% of methanol, 10% of isobutanol and 6% of 2-ethylhexanol), and 25% of water was then added, by stirring in. The vehicles described in Examples 4, 5 and 6 can be driven with this low-viscosity, stable fuel in the same manner as described in those examples.

The same good results are achieved if 1.5% of isopropanol is used instead of the alcohol mixture (to increase the gasoline constituent to 70.5%).

EXAMPLE 10

A regular-grade gasoline which is free from lead alcohols and "fluids" thereof is employed in an amount of 79%; 1.2% of the addition product of 1 mol of oleic acid amide and 7 mols of ethylene oxide (containing less than 0.8% by weight of polyethylene glycol and less than 0.07% of salts, due to purification) and 1.8% of coconut oil acid diethanolamide are dissolved in this gasoline. An opalescent emulsion is prepared by stirring a mixture of 15% of water and 3% of methanol in. The density is 0.778. A 1.7 l Opel Rekord was driven with this fuel. The performances during this test corresponded to those prescribed for this vehicle. The consumption is the same as for customary fuels (free from water and emulsifiers). After leaving to stand overnight in the open air, during which the morning temperature was −19° C., the engine could be started without problems after a few seconds. A comparison measurement of the exhaust values showed 1.5% of CO for gasoline which was free from water and emulsifiers and 0.1% of CO for the fuel according to the invention (the values were measured whilst the engine was idling at the operating temperature). No increase in the $NO_2$ value was measured.

EXAMPLE 11

The CO content in the exhaust resulting from the fuel of Example 10 according to the invention in a 3 year old vehicle was measured whilst the engine was idling at the operating temperature. The value was 0.3% of CO. Regular-grade gasoline had a value of 3.0% of CO. Mixtures of this gasoline with 15% of methanol or 15% of ethanol lead to CO values which deviate less than 0.3% from the value for regular-grade gasoline (date in German Offenlegungsschrift 2,806,673, FIG. 2, confirm our measurements for ethanol).

EXAMPLE 12

Lead-free regular-grade gasoline was processed as follows to give a fuel according to the invention: 80% of normal-grade petrol, 1.2% of an adduct of 1 mol of oleic acid amide and 7 mols of ethylene oxide and 1.8% of coconut oil acid diethanolamide (prepared from coconut oil and diethanolamine) were mixed; 15% of water, 2% of methanol and 1% of ethanol were then emulsified in, whilst stirring. This opalescent fuel produces maximum speed in a Mercedes 250 with an engine power of 95 kw (130 horse-power). For this, the main jet was adapted to the somewhat changed properties of the fuel by being widened from 97.5 to 105. The consumption established on a roller stand at a high resistance (180 kp) was comparable to that of super-grade gasoline. In spite of using regular-grade gasoline, no knocking could be heard in the engine.

The same results were achieved when an oxyalkylated oleic acid amide (prepared from oleic acid and aminopropanolamine by splitting off water and then oxyethylating the product with 6.5 mols of ethylene oxide) was used instead of the 1.2% of the oleic acid amide with 7 ethylene oxide units.

EXAMPLE 13

The following diesel fuel was formulated for driving a small lorry: 14% of water was emulsified into 82.5% of diesel oil with 0.9% of an addition product consisting of 1 mol of oleic acid amide and 7 mols of ethylene oxide, 2.1% of coconut oil acid diethanolamide (prepared from coconut oil and diethanolamine) and 0.5% of 2-ethylhexanol. Using this fuel satisfactory driving and consumption values were able to be obtained in short distance driving. However, in contrast to the commercial diesel fuel, when extracting a partial stream from the exhaust gases a white filter paper was only soiled to a hardly noticeable extent after 3 minutes, whereas the diesel fuel without emulsifiers and water caused marked blackening of the filters.

EXAMPLE 14

20% of toluene was mixed with a gasoline free from aromatic compounds and additives. 1.8% of coconut oil acid diethanol amide and 1.2% of oleic acid amide with 7 mols of ethyleneoxide were dissolved in 85% of the above mixture; 10% water and 2% ethanol were emulsified therein.

8.4 liters/100 km of this opalescent fuel emulsion were consumed in a Volkswagen vehicle (1.6 liter engine, 62 kw (85 horsepower)) according to DIN (Deutsche Industrie Norm—German Industrial Standards) condition for testing consumption. In short distance driving this value was 9.1 1/100 km. With regular-grade gasoline the same consumption values were measured under the same conditions.

When the fuel described in this example was diluted immediately after its production with the stated gasoline mixture in the ratio 1:1, the same values were able to be obtained and with completely smooth running during driving.

EXAMPLE 15

2% of a coconut oil acid ethanol amide, which had been brought to a reaction with one mol of ethylene oxide under the normal oxyethylation conditions, and 1% of oleic acid amide with 7 mols of ethylene oxide were dissolved in 75% of the gasoline mixture of Example 14. A mixture of 10% water and 2% ethanol was emulsified in this. The same values as in Example 14 were achieved with this fuel.

What is claimed is:

1. A fuel for a combustion engine consisting essentially of a hydrocarbon, water and a non-ionic emulsifier, said non-ionic emulsifier consisting essentially of the addition product of ethylene oxide or propylene oxide and a carboxylic acid amide with 9 to 21 carbon atoms, said non-ionic emulsifier being present in said fuel in an amount of 0.5 to 6% by weight.

2. A fuel according to claim 1 comprising 40 to 95 percent by weight hydrocarbon and a non-ionic emulsifier of the formula

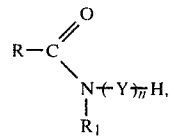

wherein

R represents an optionally substituted straight-chain or branched or cyclic, saturated or unsaturated hydrocarbon radical;

Y denotes the grouping

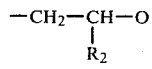

wherein $R_2$ denotes hydrogen or methyl and in which n represents an integer from 1 to 50 and $R_1$ represents hydrogen or the group $(Y)_nH$.

3. A fuel according to claim 2 containing up to 20 percent by weight of a straight-chain or branched saturated or unsaturated alcohol containing 1 to 8 carbon atoms.

4. A fuel according to claim 2 containing 0.5 to 35 percent by weight water.

5. A fuel according to claim 1 wherein said non-ionic emulsifier is an adduct of 1—3 moles of ethylene oxide and 1 mole of a carboxylic acid amide.

6. A fuel according to claim 1 wherein said non-ionic emulsifier is an adduct of 5–25 moles of ethylene oxide and/or propylene oxide and 1 mole of a carboxylic acid amide.

7. A fuel according to claim 1 wherein said non-ionic emulsifier is an adduct of 1 to 20 moles of ethylene oxide and 1 mole of fatty acid amide.

8. A fuel according to claim 1 wherein said emulsifier is an adduct of 5 to 10 moles of ethylene oxide and/or propylene oxide and 1 mole of a fatty acid amide.

9. A fuel according to claim 1 wherein said emulsifier comprises an adduct of 20 to 30 moles of ethylene oxide and 1 mole of fatty acid amide.

10. A fuel according to claim 1 wherein said hydrocarbon is a saturated or unsatured linear or a branched aliphatic hydrocarbon, naphthene-based hydrocarbon or aromatic hydrocarbon.

11. A fuel according to claim 10 which is substantially free from lead, tetraalkyls and solubilizing agents thereof.

12. A fuel according to claim 1 having a specific volume resistivity of $<1.10^{10}\ \Omega.cm$.

* * * * *